United States Patent [19]

Alford et al.

[11] Patent Number: 5,017,276

[45] Date of Patent: May 21, 1991

[54] METAL ELECTRODES FOR ELECTROCHEMICAL PROCESSES

[75] Inventors: Raymond E. Alford, West Vancouver; deceased Warren, late of Richmond, both of Canada, by Judith A. Warren, executor

[73] Assignee: Chemetics International Company Ltd., Vancouver, Canada

[21] Appl. No.: 456,738

[22] Filed: Dec. 26, 1989

[51] Int. Cl.[5] ..... C25B 11/04

[52] U.S. Cl. ..... 204/290 R; 204/291

[58] Field of Search ..... 204/290 R, 290 F, 291; 429/40, 44

[56] References Cited

U.S. PATENT DOCUMENTS 3,718,551 2/1973 Martinsons ..... 204/290 F 3,849,282 11/1974 Degueldre et al. ..... 204/290 F

*Primary Examiner*—John F. Niebling

*Assistant Examiner*—Kathryn Gorgos

*Attorney, Agent, or Firm*—Cushman, Darby & Cushman

[57] ABSTRACT

Metal electrodes provided with a coating consisting essentially of a mixed oxide compound of (i) a compound of the general formula $ABO_4$, having a structure of the rutile-type, where A is an element in the trivalent state selected from the group consisting of Al, Rh and Cr, and B is an element in the pentavalent state selected from the group consisting of Sb and Ta, (ii) $RuO_2$ and (iii) $TiO_2$; wherein the mole fraction of $ABO_4$ is between 0.01 and 0.42, the mole fraction of $RuO_2$ is between 0.03 and 0.42, and the mole fraction of $TiO_2$ is between 0.55 and 0.96. The electrodes have low precious metal content, provide improved durability and improved current efficiency-anodic overvoltage performance. They are used in the electrolysis of chloride containing liquors in the production of, for example, chlorine and more particularly, chlorate.

7 Claims, No Drawings

METAL ELECTRODES FOR ELECTROCHEMICAL PROCESSES

BACKGROUND OF THE INVENTION

This invention relates to an improved type of coating intended for constituting the active surface of a metal electrode of use in the electrolysis of alkali metal halides, and, particularly, in the production of sodium chlorate from said electrolysis.

In electrolytic cells for the production of chlorine, such as those of the diaphragm and membrane type, an aqueous solution of an alkali metal halide is electrolyzed to produce chlorine at the anode and an alkali hydroxide and hydrogen at the cathode. The products of electrolysis are maintained separate. In the production of sodium chlorate, the chlorine and alkali hydroxide are allowed to mix at almost neutral pH and the sodium chlorate is formed via disproportionation of the sodium hypochlorite formed in the above mixing.

U.S. Pat. No. 3,849,282—Deguldre et al., describes a coating for metal electrodes, which coating comprises a compound $ABO_4$ having a rutile-type structure, where A is an element in the trivalent state selected from the group rhodium, aluminum, gallium, lanthanum and the rare earths, while B is an element in the pentavalent state selected from the group antimony, niobium and tantalum, the compound $ABO_4$ being associated with an oxide of the type $MO_2$ where M is ruthenium and/or iridium. The electrodes described therein may be used in various electrochemical processes such as cathodic protection, desalination or purification of water, electrolysis of water or hydrochloric acid, production of current in a fuel cell, reduction or oxidation of organic compounds for the electrolytic manufacture of per salts, and as anodes in the electrolysis of aqueous solutions of alkali metal halides, particularly sodium chloride, in diaphragm cells, mercury cells, membrane cells and chlorate production cells, where they catalyze the discharge of chloride ions. The electrodes described therein are stated to adhere to their metal support and are stated to be resistant to electrochemical attack.

U.S. Pat. No. 3,718,551—Martinsons, describes an electroconductive coating for metal electrodes, which coating comprises a mixture of amorphous titanium dioxide and a member of the group consisting of ruthenium and ruthenium dioxide. The electrodes described therein are characterized by having a low oxygen and chlorine overvoltage, resistance to corrosion and decomposition for coatings containing less than 60% by weight of titanium (as oxide) based on the total metal content of the coatings.

Neither U.S. Pat. No. 3,718,551 or 3,849,282 gives any teaching on the current efficiency of the electrodes for the oxidation of chloride in aqueous solution. Kotowski and Busse, Modern Chlor Alkali Technology, Volume 3, page 321, comment on the relationship between overvoltage and oxygen evolution for the oxidation of aqueous chloride solutions using coatings of the type taught by U.S. Pat. No. 3,718,551 wherein a linear relationship between overpotential and log oxygen content in chlorine (increasing one - reducing the other) is given. Moreover, increasing ruthenium content is stated to result in increased oxygen evolution and reduced overpotential.

SUMMARY OF THE INVENTION

We have surprisingly discovered that admixtures of the type $ABO_4.TiO_2$ to $RuO_2$ produce a range of electrocatalysts capable of improved operation (voltage-current efficiency) over previous teachings and, moreover, for important $RuO_2$ concentrations below that which were previously believed operable.

Not all the current passing through an alkali halide-containing electrolyte is utilized in the production of the desired products. In the electrolysis of sodium halides, a minor part of the current produces oxygen at the anode rather than chlorine and this decreases the process efficiency. In electrolytic cells for the production of chlorine, the oxygen is present in the chlorine gas leaving the cells. This can lead to costly chlorine treatment processes for downstream operations. In chlorate producing cells, because there is no separator to separately confine the anodic and cathodic products, the oxygen becomes mixed with the hydrogen evolved at the cathode. Because of the danger of forming an explosive mixture, it is not desirable in general to operate chlorate-production cells with greater than 2.5% oxygen in the evolved hydrogen. Thus, the amount of oxygen evolved from an anode used for the electrolysis of halide solutions is important for process efficiency and, additionally for chlorate production, safety reasons.

A further source of oxygen in chlorate-production cells can arise due to catalytic decomposition of the intermediate sodium hypochlorite by metallic contaminants. Unfortunately, the platinum metal oxides used as electrocatalytic coatings for chloride oxidation are also excellent catalysts for hypochlorite decomposition. It is important, therefore, not only for long uniform performance life of the anode coating but also to minimize catalytic decomposition of the sodium hypochlorite that strongly adhering electrocatalytic coatings should be employed on electrodes for the electrolysis of halide solutions.

Further, electrocatalytic coatings produced solely from platinum group metal compounds can, depending upon the platinum metal used, be expensive. It is desirable, therefore, that provided the operating characteristics of low oxygen evolution, low voltage, low wear rate are satisfied, the proportion of platinum group metal in the coating should be as low as possible.

It is an object of the present invention to provide an electrode having an electrocatalytically active coating which is resistant to corrosion when used in the electrolysis of alkali metal halide solutions.

It is a further object to provide an electrode for said use having a coating with very low wear rate.

It is a further object to provide an electrode for said use having a coating which has an improved chlorine to oxygen overpotential and hence reduced electrolytically produced oxygen as a function of chlorine produced in the electrolysis of aqueous halide solutions.

It is a further object to provide an electrode for said use having a coating which has a low anodic overvoltage.

It is a further object to provide an electrode for said use having a coating having a reduced expensive precious metal content.

It is a further object to provide an electrode for said use having an improved oxygen overpotential to operation temperature performance and hence reduced electrolytically produced oxygen as a function of operation temperature increase.

DESCRIPTION OF PREFERRED EMBODIMENTS

Accordingly, the invention provides a metallic electrode for electrochemical processes comprising a metal support and on at least a portion of said support a conductive coating consisting essentially of a mixed oxide compound of (i) a compound of the general formula $ABO_4$ having a structure of the rutile-type, where A is an element in the trivalent state selected from the group consisting of Al, Rh, and Cr, and B is an element in the pentavalent state selected from the group consisting of Sb and Ta, (ii) $RuO_2$ and (iii) $TiO_2$; wherein the mole fraction of $ABO_4$ is between 0.01 and 0.42, the mole fraction of $RuO_2$ is between 0.03 and 0.42 and the mole fraction of $TiO_2$ is between 0.55 and 0.96.

The electrodes have low precious metal content and provide low wear rates and improved current efficiency-anodic overvoltage performance. They are used in the electrolysis of chloride containing liquors in the production of, for example, chlorine, and, particularly chlorate.

It is preferred to place the conductive coating of use in the present invention on a metal support at least superficially made of titanium or a metal of the titanium group. Advantageously, titanium is clad on a core of a more conductive metal such as copper, aluminum, iron, or alloys of these metals.

Preferably, the coating of use in the present invention consists essentially of the compounds as defined hereinabove in the relative amounts defined; yet more preferably, the coating consists of those compounds as defined. Thus, the compounds $ABO_4$, $RuO_2$ and $TiO_2$ must be present together in the coating in the relative amounts defined whether or not a further constituent is present in the coating.

However, it has been found advantageous to maintain certain concentrations within the above defined limits when the conductive coating is intended for the manufacture of metallic anodes for the electrolysis of chloride containing solutions, especially sodium chloride. We have surprisingly found that for particular concentrations of $RuO_2$, for example 0.1 mole fraction, below that previously considered practical, that for certain proportions of $ABO_4$ and $TiO_2$ electrochemical performance superior to that applying for mixtures of $RuO_2$ with separately $ABO_4$ and $TiO_2$ is obtained and, moreover, improved coating stability is indicated for coatings the subject of this invention than admixtures of either $ABO_4$ or $TiO_2$ with $RuO_2$.

In order that the invention may be better understood preferred embodiments will now be described by way of example only.

EXAMPLE 1

This Example illustrates the preparation and properties of an electrode having a coating of the formula:

$$AlSbO_4.2RuO_2.9TiO_2$$

A solution x was prepared by dissolving 0.54 gms of $AlCl_3$ and 1.21 gms of $SbCl_5$ in 40 mls of n-butanol and a solution y was prepared by dissolving 2.0 gms of finely ground $RuCl_3.xH_2O$(40.89% Ru) in 40 mls of n-butanol.

Solutions x and y were brought together with 13.1 mls $(CH_3(CH_2)_3O)_4$ Ti and mixed well. This solution was applied in six layers onto plates of titanium which had previously been hot-degreased in trichloromethylene, vacu-blasted, and then etched for seven hours at 80° C. in 10% oxalic acid solution. After each application of the coating mixture the plates were dried with infra-red lamps and then heated in air for fifteen minutes at 450° C. After the sixth coating application the titanium plates, now fully coated, were heated for 1 hour at 450° C. The amount of material thus deposited was about 8 g/m$^2$.

The coating which had a mole fraction of $AlSbO_4$ of 0.08, $RuO_2$ of 0.17 and $TiO_2$ of 0.75 showed excellent adherence to the titanium substrate, as was shown by stripping tests with adhesive tape applied by pressure, both before and after operation in electrolytic cells for the production of sodium chlorate.

The titanium plates thus coated were submitted to four further types of evaluation.

The first evaluation relates to the electrode performance with regard to oxygen formation when used in a cell producing sodium chlorate under commercial conditions.

The second evaluation relates to the anodic voltage when the electrode is used under typical conditions of commercial sodium chlorate production.

The third evaluation relates to the performance of the coating under accelerated wear tests under conditions where the final anodic product is sodium chlorate but the production conditions are very much more aggressive than those encountered in commercial practice.

The fourth evaluation relates to the performance of the coating under accelerated wear conditions where the anodic product is chlorine but the production conditions are very much more aggressive than those encountered in commercial practice.

The first test was performed with an electrolyte at 80° C. containing 500 g/l $NaClO_3$, 110 g/l NaCl and 5 g/l $Na_2Cr_2O_7$. The electrolyte was circulated past the coated titanium anode produced above at a fixed rate in terms of liters/Amp-hour and the oxygen measured in the cell off-gases over a range of current densities between 1 and 3 kA/m$^2$. (See for example, Elements of Chlorate Cell Design, I. H. Warren and N. Tam in Modern Chlor-Alkali Technology, Vol. 3, Editor K. Wall. Ellis Harwood Ltd. Publishers, Chichester England (1985)).

The second test was performed with the same apparatus as for the first test but with a Luggin capillary probe used to measure the anodic voltage at various current densities before and after prolonged operation. (See, for example, Application of Backside Luggin Capillaries in the Measurement of Non-uniform Polarization, M. Eisenberg, C. N. Tobias and C. R. Wilke, J Electrochem Soc., July 1955, pp. 415–419).

The third test was performed using an electrolyte containing 500 g/l of $NaClO_3$ and only 20 g/l of NaCl with 5 g/l $Na_2Cr_2O_7$. The electrodes were operated in a chlorate production cell at 80° C. and 5 kA/m$^2$. (See, for example, An Accelerated Method of Testing The Durability of Ruthenium Oxide Anodes for the Electrochemical Process of Producing Sodium Chlorate, L. M. Elina, V. M. Gitneva and V. I. Bystrov., Elektrokimya, Vol. II, No. 8, pp 1279–1282, August 1975).

The fourth test was performed using an electrolyte containing 1.85M $HClO_4$ and 0.25M NaCl. The electrodes were operated in a chlorine production cell at 30° C. and at constant cell voltage using a potentiostat. The current under constant voltage was recorded until it changed significantly which indicated the time-to-failure of the test electrode. (See, for example, Electrochemical Behaviour of the Oxide-Coated Metal Anodes, F. Hine, M. Yasuda, T. Noda, T. Yoshida and J. Okuda., J. Electrochem Soc., September 1979, pp 1439–1445).

The oxygen content of the gases exiting the chlorate production cell in the first test was 1.5% at 2kA/m$^2$ at 80° C. for the electrode prepared in the above example. In the second test the anode voltage was measured to be 1.14 volts vs. S.C.E. also at 2kA/m$^2$ and 80° C. In addition, the sample electrode was rechecked after running for 103 days under the same operating conditions as in the first test and the result showed no change in anodic voltage.

In the third test, the cell voltage started to rise after nine days of operation under accelerated wear testing conditions for chlorate production (an indication of time-to-failure), but the coating was still strongly adherent on the substrate.

In the fourth test, the resistivity of the coating increased significantly after two hours of operation under accelerated wear testing conditions for chlorine production.

The performance of this coating in tests 1 and 2 above was surprising in relation to the performance of coatings with the same $RuO_2$ content but with separately admixtures of $TiO_2$ and $AlSbO_4$ as evidenced by the data given in Table 1. Here, the function of anodic voltage-oxygen in chlorine is seen to be beneficial over the other coatings and contrary to that which might be expected (Kotowski and Busse Modern Chlor-Alkali Technology Vol. 3, pp 321) on the basis of the $RuO_2$ content.

TABLE 1

Effect of Molar Contents of $AlSbO_4$ and $TiO_2$ (with fixed $RuO_2$ content) on Anodic Voltage and Oxygen Evolution at 2kA/m$^2$ and 80° C.

| Coating Composition Mole Fraction | | | Anodic | Oxygen in | Coating |
|---|---|---|---|---|---|
| $AlSbO_4$ | $RuO_2$ | $TiO_2$ | Voltage | Chlorine | Stability |
| 0.08 | 0.17 | 0.75 | 1.14 | 1.5 | Good |
| 0.83 | 0.17 | — | 1.32 | 0.7 | Poor |
| — | 0.17 | 0.83 | 1.14 | 2.1 | Good |

The $AlSbO_4RuO_2$ coating was characterized by a high voltage and poor mechanical stability. The $RuO_2.TiO_2$ coating demonstrated a much higher oxygen evolution and therefore lower efficiency and poorer overall performance. The coating, the subject of this invention, demonstrated a superior overall electrochemical performance. Moreover, accelerated testing of the mixed coating, the subject of this invention, indicated a superior life to that of the $RuO_2TiO_2$ admixture and in this respect it is noted that commercial coatings of this general composition usually contain more than 20% MF $RuO_2$. It was also surprising that the $AlSbO_4RuO_2$ coating demonstrated such poor stability in the light of the teachings of U.S. Pat. No. 3,849,282.

EXAMPLE 2

This Example illustrates the preparation and properties of an electrode having a coating of the formula:

$AlTaO_4.2RuO_2.9TiO_2$.

A solution x was prepared by adding 0.53 gms $AlCl_3$ and 1.44 gms $TaCl_5$ to 40 mls of n-butanol. A solution y was prepared by dissolving 2.0 gms of finely ground $RuCl_3 1-3H_2O$ (40.2% Ru) in 40 mls of n-butanol.

Solutions x and y were then mixed well with 12.87 mls of tetrabutyl orthotitanate ($CH_3(CH_2)_3O)_4Ti$). The mixture was applied by brushing on six successive coats to a cleaned and etched titanium plate with drying and heating of each coat and a final heat treatment as for Example 1. The amount of material deposited was about 8 g/m$^2$. The coating showed excellent adherence to the substrate, as was shown by stripping tests with adhesive tape applied by pressure, both before and after operation in electrolytic cells for the production of chlorate.

When used as an anode in a chlorate cell, the oxygen content of the gases exiting the cell was 1.4% at 2kA/m$^2$ and 80° C. The anodic voltage under the same operating conditions was 1.14 volts vs. S.C.E.

The accelerated wear test, using the chlorate electrolyte with low chloride content, (third test) showed that the cell voltage started to rise after 14 days of operation. In addition, the resistivity of the coating increased significantly after 0.5 hours of operation under accelerated wear testing conditions for chloring production for the above electrode.

This coating confirms the beneficially synergistic effect of the classes of components, the subject of this invention.

EXAMPLE 3

This Example illustrates the preparation and properties of an electrode having a coating of the formula:

$CrSbO_4.2RuO_2.9TiO_2$

A solution x was prepared by adding 1.16 gms $CrBr_3$ and 1.19 gms $SbCl_5$ to 40 mls of n-butanol. A solution y was prepared by dissolving 2 gms of finely ground $RuCl_3.1-3H_2O$ (40.2% Ru) in 40 mls of n-butanol. Solutions x and y were then mixed well with 12.9 mls of tetrabutyl orthotitanate ($CH_3(CH_2)_3O)_4Ti$). The mixture was coated (6x) to a cleaned and etched titanium plate using the same techique as for Example 1. The amount of material deposited was about 8 g/m$^2$.

The coating stability was excellent. The anode voltage and the oxygen content of the gases exiting the cell were 1.11 volts vs. S.C.E. and 2% respectively under the same operating conditions as in Example 2. This coating demonstrates a further improvement in voltage than hitherto found and surprisingly well below that expected from earlier teachings.

EXAMPLE 4

This Example illustrates the preparation and properties of an electrode having a coating of the formula:

$RhSbO_4.2RuO_2.9TiO_2$

A solution x was prepared by adding 0.975 gms of $RhCl_3.xH_2O$ (42.68% Rh) and 1.1 gms of $SbCl_5$ to 40 mls of n-butanol. A solution y was prepared by dissolving 2 gms of finely ground $RuCl_3.xH_2O$ (40.89 T Ru) in 40 mls of n-butanol. Solutions x and y were then mixed well with 13.1 mls of tetrabutyl orthotitanate. The mixture was coated (6×) to a cleaned and etched titanium plate using the same technique as for Example 1. The amount of material deposited was about 8 g/m$^2$.

The coating showed excellent coating stability, both before and after operation in electrolytic cells for the production of chlorate. Under the same operating conditions as in Example 2, the anodic voltage and the oxygen content of the gases exiting the cell were found to be 1.13 volts vs. S.C.E. and 1.33% respectively. The overvoltage of the coating increased significantly after 6.5 hours of operation under accelerated wear testing conditions for chlorine production.

This coating again demonstrates a significantly better voltage-current efficiency performance than would have hitherto been expected and potentially shows a further technical advantage of coating the subject of this invention where A is Rh over the previously exemplified Al.

EXAMPLE 5

This Example illustrates the surprisingly good voltage-current efficiency performance of coatings of the general formula $aABO_4bRuO_2cTiO_2$ in relation to coatings of the type $aABO_4bRuO_2$ and $bRuO_2cTiO_2$.

The coatings were prepared as generally described for Example 1 with appropriate concentrations of the species required for the desired coating formulation.

The performance of the coatings was determined using the procedures given for Example 1 and the results obtained are given in Table 2.

TABLE 2

Effect of Various Coating Compositions on Anodic Voltage and Oxygen Evolution at 2kA/m$^2$ and 80° C.

| Mole Ratios | | | Anodic Voltage Volts | Oxygen in | Coating |
|---|---|---|---|---|---|
| $AlSbO_4$ | $RuO_2$ | $TiO_2$ | v/s SCE | Offgas | Stability |
| 0 | 0.03 | 0.97 | 2.12 | 1.4 | Good |
| 0.02 | 0.03 | 0.95 | 1.98 | 1.2 | Good |
| 0.16 | 0.03 | 0.80 | 1.38 | 0.8 | Good |
| 0 | 0.10 | 0.90 | 1.22 | 1.5 | Good |
| 0 | 0.20 | 0.80 | 1.14 | 2.1 | Good |
| 0.04 | 0.20 | 0.76 | 1.14 | 1.9 | Good |
| 0.8 | 0.20 | 0 | 1.32 | 0.7 | Poor |
| 0.01 | 0.30 | 0.69 | 1.14 | 2.6 | Good |
| 0.18 | 0.30 | 0.52 | 1.14 | 1.4 | Fair |
| 0.56 | 0.30 | 0.14 | 1.19 | 1.1 | Poor |
| 0 | 0.50 | 0.50 | 1.12 | 4.9 | Fair |
| 0.25 | 0.50 | 0.25 | 1.16 | 1.1 | Fair |
| 0.50 | 0.50 | 0 | 1.13 | 2.0 | Poor |

The performance of these coatings confirm that coatings of the type $RuO_2TiO_2$, where the mole fraction of $RuO_2$ is below 0.2 exhibit poor overall performance. It is surprising from the teachings of U.S. Pat. No. 3,849,282 that coatings of the type $AlSbO_4RuO_2$ show poor coating stability. It is surprising that admixtures of $AlSbO_4$ and $TiO_2$ together with $RuO_2$ produce improved performance over admixtures of either separately. The reducing overvoltage and oxygen in off-gas concentrations for $AlSbO_4$ and $TiO_2$ admixtures to $RuO_2$, where the $RuO_2$ mole fraction is 0.03 is particualrly surprising in the light of earlier teaching by Kotowski and Busse. For $RuO_2$ mole fractions of 0.2, the improved performance for a small $AlSbO_4$ content in an $AlSbO_4TiO_2$ admixture over $AlSbO_4$ or $TiO_2$ alone is of particular note and which is more marked for greater amounts within an optimum range, for higher $RuO_2$ mole fractions.

EXAMPLE 6

This Example illustrates the preparation and properties of further electrodes according to the invention. A series of coated titanium sheets was made up using the same technique as for Example 1. However, for these plates, the relative amounts of solutions x, y and butyl titanate were varied to provide coatings with a range of $AlSbO_4RuO_2TiO_2$ contents. The anodic voltages and oxygen contents of the cell gases of the various coated sheets are shown in Tables 3 and 4. The wear rates of all these coatings both before and after operation, as measured by the tape test were excellent.

TABLE 3

Effect of Molar Contents of $AlSbO_4$ and $RuO_2$ (with fixed $TiO_2$ content) On Anodic Voltage and Oxygen Evolution at 2kA/m$^2$ and 80° C.

| Mole Ratios | | | Anodic Voltage Volts | Oxygen in |
|---|---|---|---|---|
| $AlSbO_4$ | $RuO_2$ | $TiO_2$ | v/s SCE | Offgas |
| 0.08 | 0.17 | 0.75 | 1.14 | 1.5 |
| 0.125 | 0.125 | 0.75 | 1.15 | 1.6 |
| 0.17 | 0.08 | 0.75 | 1.29 | 1.1 |
| 0.20 | 0.05 | 0.75 | 1.40 | 0.9 |

Commercial anodes demonstrate anodic voltages of typically 1.14 volts vs. S.C.E. and off-gas oxygen concentreations of 2 to 3% under the above operating conditions. The anode according to the invention with a molar fraction of $AlSbO_4$ of 0.08 and $RuO_2$ of 0.17 has a comparable anodic voltage which is surprising from the teaching of Martinsons and, for this low anodic voltage a surprisingly high efficiency from the teaching of Kotowski and Busse.

TABLE 4

Effect of Molar Content of $AlSbO_4$, $RuO_2$ and $TiO_2$ On Anodic Voltage and Oxygen Evolution at 2kA/m$^2$ and 80° C.

| Mole Ratios | | | Anodic Voltage Volts | Oxygen in |
|---|---|---|---|---|
| $AlSbO_4$ | $RuO_2$ | $TiO_2$ | v/s SCE | Offgas |
| 0.03 | 0.07 | 0.90 | 1.23 | 1.6 |
| 0.05 | 0.10 | 0.86 | 1.18 | 1.5 |
| 0.08 | 0.17 | 0.75 | 1.14 | 1.5 |
| 0.13 | 0.27 | 0.60 | 1.14 | 1.6 |

Surprisingly, in relation to the teaching of Kotowski and Busse, reducing the $RuO_2$ content results in coatings with constant oxygen evolution and surprisingly low overvoltages for the low $RuO_2$ contents when compared to commercial $RuO_2TiO_2$ coatings which contain $RuO_2$ at typically above 0.3 MF and $ABO_4RuO_2$ coatings which contain $RuO_2$ at typically 0.5 MF.

EXAMPLE 7

This Example illustrates the surprisingly good oxygen overpotentials to oxygen evolution relationship of the electrodes according to the invention. A coated titanium sheet was made up using the same technique as for Example 1. In addition titanium sheets were made up using the technique generally described for Example 1 to give admixtures separately of $RuO_2TiO_2$ and $RhSbO_4RuO_2$.

These electrodes were assessed using the first test described in Example 1 and additionally the second test but with the use of a 1M sulphuric acid electrolyte to determine the oxygen overpotential. The performance of the various coating compositions is given in Table 5.

TABLE 5

Effect of Various Coating Compositions on Oxygen Overpotential and Oxygen Evolution at 2kA/m$^2$ and 80° C.

| Mole Ratios | | | | Oxygen Overpotential volts | Oxygen in |
|---|---|---|---|---|---|
| $AlSbO_4$ | $RhSbO_4$ | $RuO_2$ | $TiO_2$ | V/s NHE | Offgas |
| — | — | 0.08 | 0.92 | 2.09 | 1.5 |

TABLE 5-continued

Effect of Various Coating Compositions on Oxygen Overpotential and Oxygen Evolution at 2kA/m$^2$ and 80° C.

| Mole Ratios | | | | Oxygen Overpotential volts | Oxygen in |
|---|---|---|---|---|---|
| $AlSbO_4$ | $RhSbO_4$ | $RuO_2$ | $TiO_2$ | V/s NHE | Offgas |
| — | — | 0.10 | 0.90 | 2.01 | 1.7 |
| — | — | 0.20 | 0.80 | 1.77 | 2.1 |
| — | — | 0.24 | 0.76 | 1.65 | 3.5 |
| — | — | 0.50 | 0.50 | 1.60 | 4.9 |
| 0.33 | — | 0.67 | — | 1.67 | 2.1 |
| — | 0.33 | 0.67 | — | 1.63 | 2.7 |
| 0.08 | — | 0.17 | 0.75 | 1.81 | 1.5 |
| — | 0.08 | 0.17 | 0.75 | 1.76 | 1.3 |

For the $RuO_2TiO_2$ coated titanium electrodes, a relationship is found between oxygen overpotential and oxygen in off-gas which is related to the ruthenium content though a linear relationship of the type quoted by Kotowski and Busse was not found. The coatings of the type $ABO_4RuO_2$ were found comparably to perform similarly to the $RuO_2TiO_2$ formulation, in respect of this test, for the $RuO_2$ content present. Surprisingly, coatings, the subject of the invention, gave a much improved performance for the comparable $RuO_2$ content.

EXAMPLE 8

This Example illustrates the surprisingly good oxygen overpotentials of the electrodes according to the invention as a function of operating temperature. Coated titanium sheets were made up using the same technique as for Example 1. In addition, titanium sheets were made up using the technique generally described for Example 1 to give a coating of the composition $AlSbO_4.2RuO_2$. The oxygen overpotential of these electrodes was measured as described in Example 7 over a range of temperatures. The results are given in Table 6.

TABLE 6

Effect of Coating Composition on Oxygen Overpotential with temperature at 2kA/m$^2$

| Mole Ratios | | | Temperature | Oxygen Overpotential |
|---|---|---|---|---|
| $AlSbO_4$ | $RuO_2$ | $TiO_2$ | °C. | V v/s NHE |
| 0.33 | 0.67 | — | 25 | 1.98 |
| 0.33 | 0.67 | — | 60 | 1.73 |
| 0.33 | 0.67 | — | 80 | 1.67 |
| 0.08 | 0.17 | 0.75 | 25 | 2.04 |
| 0.08 | 0.17 | 0.75 | 60 | 1.94 |
| 0.08 | 0.17 | 0.75 | 80 | 1.85 |

The electrodes, the subject of the invention, show a reduced temperature effect on oxygen overpotential and in turn facilitate the opportunity for further process improvements in the ability for coatings, the subject of this invention, to operate satisfactory electrolysis applications at temperatures higher than that traditionally considered inoperable.

The embodiments of the invention in which an exclusive property or privilege is claimed are defined as follows:

1. A metallic electrode for electrochemical processes comprising a metal support and on at least a portion of said support, a conductive coating consisting essentially of a mixed oxide compound of (i) a compound of the general formula $ABO_4$ having a rutile structure, where A is an element in the trivalent state selected from the group consisting Al, Rh, and Cr, and B is an element in the pentavalent state selected from the group consisting of Sb and Ta, (ii) $RuO_2$, and (iii) $TiO_2$; wherein the mole fraction of $ABO_4$ is in the 0.01 to 0.42 range and the mole fraction of $RuO_2$ is in the range 0.03 to 0.42 and the mole fraction of $TiO_2$ is in the range of 0.14 to 0.96.

2. A metallic electrode as claimed in claim 1, wherein the mole fractions are in the following ranges: $AlSbO_4$ 0.05—0.3, $RuO_2$ 0.03—0.3 and $TiO_2$ 0.55—0.92.

3. A metallic electrode as claimed in claim 1 or claim 2, wherein the mole fractions are in th following ranges: $ABO_4$ 0.05—0.2, $RuO_2$ 0.03—0.2 and $TiO_2$ 0.6—0.92.

4. A metallic electrode as claimed in claim 1 or claim 2, wherein A is trivalent Al.

5. A metallic electrode as claimed in claim 1 or claim 2, wherein B is pentavalent Sb.

6. A metallic electrode as claimed in claim 1 wherein the mixed oxide compound has the composition $AlSbO_4.RuO_2.7.5TiO_2$.

7. A metallic electrode achieved in claim 1 wherein the mixed oxide has the formula AlSbOhd $4.2RuO_2.9TiO_2$.

* * * * *